US005639025A

United States Patent [19]

Bush

[11] Patent Number: 5,639,025

[45] Date of Patent: Jun. 17, 1997

[54] HIGH VISCOSITY PUMP SPRAYER UTILIZING FAN SPRAY NOZZLE

[75] Inventor: Stephan G. Bush, Cincinnatti, Ohio

[73] Assignee: The Procter & Gamble Company, Cincinnati, Ohio

[21] Appl. No.: 499,753

[22] Filed: Jul. 7, 1995

[51] Int. Cl.[6] ..... B05B 9/043; B05B 1/14

[52] U.S. Cl. ..... 239/333; 239/568; 239/597; 239/601

[58] Field of Search ..... 239/71, 73, 333, 239/597, 599, 601, 568, 123, 121, 120, 114–116, 107, 106; 222/383.1

[56] References Cited

U.S. PATENT DOCUMENTS

| | | | |
|---|---|---|---|
| D. 198,356 | 6/1964 | Wahlin | 23/213 |
| D. 226,712 | 4/1973 | Tada | D23/226 |
| 2,621,078 | 12/1952 | Wahlin | 239/597 |
| 2,755,137 | 7/1956 | Hughf | 239/602 X |
| 2,812,213 | 11/1957 | Bede | 239/544 |
| 2,985,386 | 5/1961 | Steinen | 239/597 |
| 3,250,474 | 5/1966 | McKernan | 239/123 X |
| 3,346,195 | 10/1967 | Groth | 239/337 |
| 3,488,006 | 1/1970 | Gigantino | 239/602 X |
| 3,647,147 | 3/1972 | Cook | 239/599 |
| 3,701,478 | 10/1972 | Tada | 239/333 |
| 4,011,992 | 3/1977 | Olsen | 239/135 |
| 4,097,000 | 6/1978 | Derr | 239/599 |
| 4,109,869 | 8/1978 | Brockelsby et al. | 239/491 |

(List continued on next page.)

FOREIGN PATENT DOCUMENTS

| | | | |
|---|---|---|---|
| 554493 | 1/1960 | Belgium | 239/599 |
| 466157A2 | 1/1992 | European Pat. Off. . | |
| 2689864 | 10/1993 | France . | |
| 244909 | 4/1975 | Germany . | |
| 83/00134 | 1/1983 | WIPO . | |
| 93/06749 | 4/1993 | WIPO . | |
| 93/21081 | 10/1993 | WIPO . | |

OTHER PUBLICATIONS

Pattern Measurements in Fan Spray Atomizers with High Viscosity Fluids by Steven G. Bush, Dimitris I. Collias (May, 1996).

Thermoplastic Elastomers—A Comprehensive Review, Edited by N.R. Legge, G. Holden, H.E. Schroeder (Jul., 1987): Chapter 13—Applications of Thermoplastic Elastomers by G. Holden (pp. 481–506).

Atomization and Sprays by Arthur H. Lefebvre, 1989 (pp. 6, 10, 61, 125–127).

Mechanisms of liquid sheet breakup and the resulting drop size distributions, Feb. 1992 Tappi Journal, (pp. 136–142).

Continental Sprayers, Inc. 922 Ajust–o–Spray pamphlet.

Lechler, Catalog #140, Industrial Spray Nozzles, Systems and Accessories.

*Primary Examiner*—Lesley D. Morris

*Attorney, Agent, or Firm*—Michael E. Hilton; Michael J. D'Amelio; Daniel F. Nesbitt

[57] ABSTRACT

A hand holdable spray delivery system for dispensing a fluid is provided. This spray delivery system includes a container adapted to house the fluid. The fluid being relatively viscous and preferably also being solids laden. A manually actuated pump device is mounted on the container. The pump device including an inlet passage, a pump chamber, and a discharge passage having a distal end connected in fluid communication so that the fluid is pumped from within the container, through the inlet passage, into the pump chamber and through the discharge passage upon manual actuation of the pump device. A spray nozzle including a housing having an inlet side and an exit side is also included. The housing having an internal recess through the inlet side that terminates in an elongated orifice at the exit side. The internal recess being attached in fluid communication to the distal end of the discharge passage such that the fluid passing through the discharge passage flows through the spray nozzle and converges toward the elongated orifice. The fluid being dispensed therefrom in a fan spray pattern. Several versions of the spray delivery system are illustrated, including a trigger operated sprayer and a reciprocating finger pump.

7 Claims, 7 Drawing Sheets

U.S. PATENT DOCUMENTS

| | | | |
|---|---|---|---|
| 4,127,419 | 11/1978 | Szuhaj et al. | 106/243 |
| 4,142,003 | 2/1979 | Sejpal | 426/601 |
| 4,155,770 | 5/1979 | Doumani | 106/267 |
| 4,156,398 | 5/1979 | McDaniel | 118/704 |
| 4,174,069 | 11/1979 | Grogan | 239/333 |
| 4,252,507 | 2/1981 | Knickerbocker | 417/444 |
| 4,256,526 | 3/1981 | McDaniel | 156/295 |
| 4,346,849 | 8/1982 | Rood | 239/597 |
| 4,384,008 | 5/1983 | Millisor | 426/613 |
| 4,385,076 | 5/1983 | Crosby | 426/533 |
| 4,401,271 | 8/1983 | Hansen | 239/337 |
| 4,401,272 | 8/1983 | Merton et al. | 239/337 |
| 4,618,101 | 10/1986 | Piggott | 239/599 X |
| 4,627,414 | 12/1986 | Chazin | 126/215 |
| 4,736,892 | 4/1988 | Calder | 239/599 X |
| 4,747,523 | 5/1988 | Dobbs | 222/383.1 |
| 4,893,754 | 1/1990 | Ruiz | 239/601 |
| 4,905,911 | 3/1990 | Sakuma | 239/599 |
| 4,925,699 | 5/1990 | Fagan | 427/483 |
| 4,986,453 | 1/1991 | Lina et al. | 222/321.2 |
| 4,988,043 | 1/1991 | Lechler | 239/597 |
| 5,088,649 | 2/1992 | Hanson et al. | 239/329 |
| 5,110,616 | 5/1992 | Lair et al. | 427/9 |
| 5,133,502 | 7/1992 | Bendig et al. | 239/504 |
| 5,137,793 | 8/1992 | Cockrell, Jr. | 428/688 |
| 5,249,747 | 10/1993 | Hanson et al. | 239/373 |
| 5,271,566 | 12/1993 | Dederich | 239/600 |
| 5,358,179 | 10/1994 | Lund et al. | 239/333 |
| 5,366,553 | 11/1994 | Lair et al. | 118/682 |
| 5,455,055 | 10/1995 | Stolz | 426/115 |
| 5,538,188 | 7/1996 | Simonette | 239/599 |

HIGH VISCOSITY PUMP SPRAYER UTILIZING FAN SPRAY NOZZLE

FIELD OF THE INVENTION

The present invention relates to packages for dispensing fluid products; and more particularly, to a manually operated spray delivery system for dispensing of difficult to spray (e.g. viscous and/or solids laden) fluids in a defined spray pattern.

BACKGROUND OF THE INVENTION

The quantity of the liquid product dispensed and the quality of the dispersed spray pattern are important parameters which can have a substantial impact on the performance of a liquid product applied via an atomized spray. This is particularly true when a relatively viscous liquid product is being utilized as a thin, uniform coating on a surface, and the total quantity of liquid product applied and quality of the spray pattern directly impact the thickness and uniformity of the product coating.

Aerosol spray type dispensers have been utilized to atomize relatively viscous fluids, however, recently there has been a trend away from aerosol-type dispensing systems for environmental reasons. Thus, the use of a propellant, regardless of the type, makes an aerosol container less desirable than hand pump type spray dispensers.

Many manually actuated pump sprayer type dispensers have also been utilized to atomize fluids. However, when dispensing relatively viscous products such as cooking oil or vegetable oil based pan coatings, these devices have generally resorted to a dual stream impingement type nozzle. There are some problems and disadvantages to the impingement type nozzle when used to dispense such products. These impingement type nozzles are more difficult to manufacture because the individual passages of the nozzle must be properly aligned with the precision required for repetitively producing discharge streams that intersect or collide at a particular point in order for atomization of the fluid product to occur. Additionally, the small size of the multiple exit orifices required in an impingement nozzle, for increasing the velocity of the fluid, are prone to clog when dispensing a solids laden liquid product.

When using a manually actuated pump sprayer to dispense relatively viscous liquid products some challenges exist when dispensing the liquid in a dispersed spray. These relatively viscous liquids typically have a tendency to resist break-up rather than easily being dispensed in a dispersed spray. As a general proposition, the less finely dispersed the atomized spray, the more difficult it is to achieve a comparatively thin and uniform coating of product on a surface.

Also problematic when dispensed using a manually actuated pump sprayer are solids laden liquid products, that is, liquids having a substantial amount of solid materials suspended in them. Typically, liquid products that contain solid particles have a tendency to clog and obstruct the small passageways of spray nozzles. Thus, dispensing of liquid products in a dispersed spray is especially problematic when a relatively viscous liquid is combined with a substantial amount of solid materials.

One particularly troublesome product to dispense with a manually operated pump sprayer, because it is relatively viscous and generally solids laden, is a vegetable oil based product used in food preparation, such as pan coatings and flavor enhancers. Such fluid products usually comprise a vegetable oil and may optionally include a quantity of additives for stability, performance, and flavor enhancement. A thin, uniform coating of an oil-based product is desirable in order to provide for non-stick baking characteristics in the pan and to prevent over-application of the flavor enhancers. These products generally have a comparatively high viscosity and these relatively viscous products may also include a substantial amount of solids and particles suspended in them.

SUMMARY OF THE INVENTION

In one aspect of the present invention, a hand holdable spray delivery system for dispensing a fluid is provided. This spray delivery system includes a container adapted to house the fluid. The fluid being relatively viscous and preferably also being a solids laden liquid. Preferably, the fluid has a viscosity from about 80 centipoise to about 300 centipoise and preferably, contains up to about 10% solid particulate material. Even more preferably the fluid is a vegetable oil based cooking spray. A manually actuated pump device is mounted on the container. The pump device including an inlet passage, a pump chamber, and a discharge passage having a distal end connected in fluid communication so that the fluid is pumped from within the container, through the inlet passage, into the pump chamber and through the discharge passage upon manual actuation of the pump device. A spray nozzle including a housing having an inlet side and an exit side is also included. The housing has an internal recess through the inlet side that terminates in an elongated orifice at the exit side. The internal recess is attached in fluid communication to the distal end of the discharge passage such that the fluid passing through the discharge passage flows through the spray nozzle and converges toward the elongated orifice. The internal recess preferably having a dome shaped interior surface therein and the exit side preferably having a groove therein which intersects with the interior surface of the internal recess to form the elongated orifice. More preferably the groove is "V-shaped" and has an included angle having a range from about 30° to about 50°. The fluid being dispensed therefrom in a fan spray pattern. A post is also provided and is affixed to the distal end of the discharge passage so as to allow the fluid to flow through the discharge passage in an open position. This spray nozzle being moveable between the open position and a closed position. The post preferably has a contour and size that is substantially the same as that of the interior surface.

BRIEF DESCRIPTION OF THE DRAWINGS

While the specification concludes with claims which particularly point out and distinctly claim the invention, it is believed that the present invention will be better understood from the following description taken in conjunction with the appended claims and the accompanying drawings, in which like reference numerals identify identical elements and wherein;

FIG. 5A is a cross-section of the spray nozzle taken along line 5B—5B of FIG. 4 and showing a portion of the discharge passage;

DETAILED DESCRIPTION OF THE INVENTION

Figure 1:
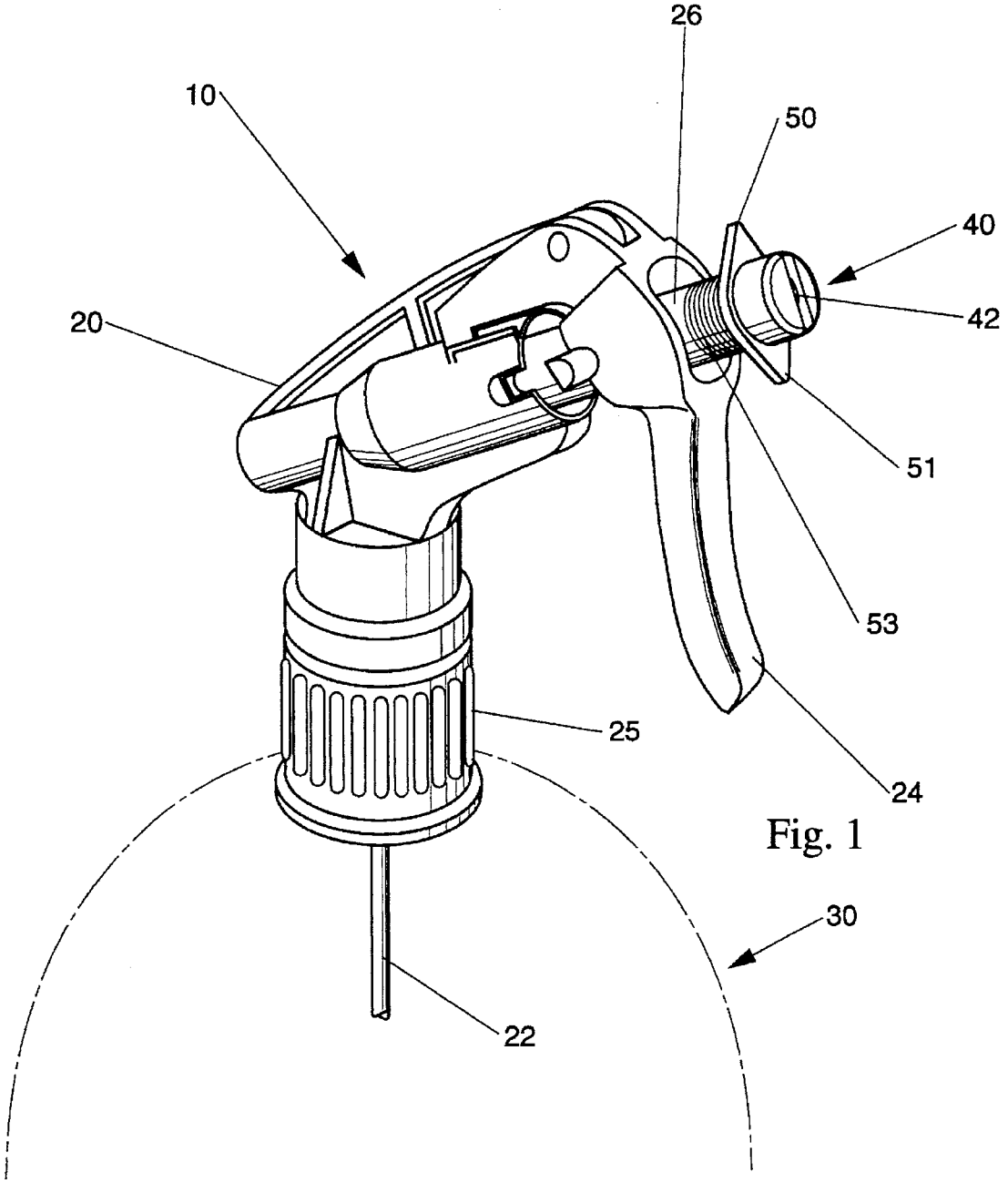
FIG. 1 is a perspective view of a spray delivery system according to the present invention, with the container shown via phantom line.

In a particularly preferred embodiment seen in FIG. 1, the present invention provides a hand holdable spray delivery system, indicated generally as 10, for dispensing a fluid. The spray delivery system 10 includes a fan slot spray nozzle 40 connected to a manually actuated pump device 20 and a container 30 (shown in outline only) adapted to house a fluid.

Figure 2:
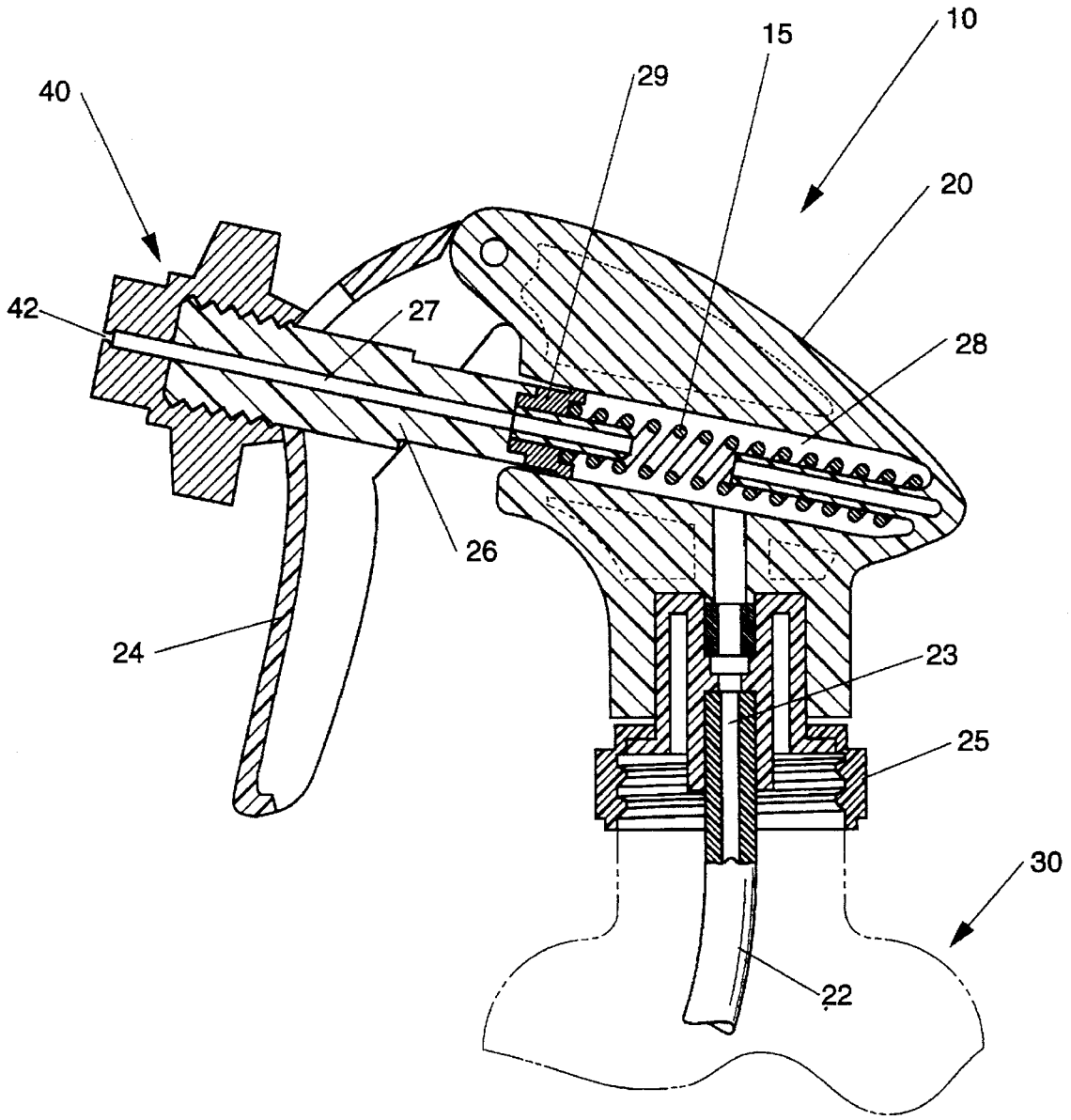
FIG. 2 is a partial cross-section of the spray delivery system seen in FIG. 1, according to the present invention.

Referring to FIG. 2, an inlet tube 22 having an inlet passage 23 therethrough extends downward into the container 30 from the pump device 20. The fan slot spray nozzle 40 is connected to a discharge tube 26 of the pump device 20. The discharge tube 26 has a discharge passage 27 extending therethrough, the discharge passage 27 having a distal end and a proximate end. The proximate end of the discharge passage 27 is connected to a pump chamber 28. The spray nozzle 40 being attached in fluid communication to the distal end of the discharge passage 27 such that the fluid passing through the discharge passage 27 flows through the spray nozzle 40 and is dispensed therefrom in a fan spray pattern.

A wide variety of manually operated pump sprayer type mechanisms may be suitable for use in the present invention. A more detailed description of the features and components of the pump device 20 may be found in U.S. Pat. No. 3,701,478 issued Oct. 31, 1972 to Tada, which is hereby incorporated herein by reference. Pump devices 20 of this general type are commercially available versions sold by Continental Manufacturing Co. under the trade name "922 Industrial Sprayer". While the above-mentioned pump device 20 may be presently preferred, many other standard manually operated pump sprayer mechanisms could also function in this capacity. The particular trigger operated sprayer type pump device 20 seen in FIG. 2 is illustrative of the operating features typical of such manually actuated pumps and is a presently preferred configuration for commercial applications.

As seen in FIG. 2 the pump device 20 is used to convey fluid from the container 30, to pressurize the fluid, and then pass this pressurized fluid through the spray nozzle 40. In this presently preferred embodiment, the trigger 24 serves as an actuator that reciprocally engages a piston 29 that is slidably fitted within the pump chamber 28 in order to effectuate actuation of the spray delivery system 10. It is preferable for the pump device 20 to dispense about 1 cc to about 3 cc of fluid during each actuation stroke or dispensing cycle. The force required to dispense the fluid is the amount of force that the operator must exert on the trigger 24 in order to actuate the pump device 20. This force to dispense should be easy and non-fatiguing to the operator's fingers and hand. Preferably, the force to dispense is less than about 10 pounds at an actuation rate of from about 3 inches per second to about 4 inches per second; and more preferably, the force to dispense is from about 5 pounds to about 8 pounds.

Certain aspects of the configuration of the pump device 20 are dependent on the nature of the fluid which is to be dispensed. The fluid dispensed by this spray delivery system 10 is a relatively viscous fluid. In the case of a Newtonian fluid (where viscosity is not dependent on shear rate) the absolute viscosity of the fluid is measured using, for example, a Haake RV20 Rotovisco rotary rheometer. One sensor system used for relatively viscous fluids is the PK45/4° cone and plate system. The clearance from plate to cone truncation for this system is about 0.175 mm. The sample temperature is maintained at from about 21° C. to about 25° C., which is representative of room temperature conditions. Rotation of the plate induces shear in the sample between the plate and cone. The viscosity is calculated by the software from the resultant shear induced torque on the cone. This viscosity data is obtained using the Haake Rotovisco software version 2.1, where the shear rate is programmed by the user and the ensuing data acquisition and post processing are automated processes. Shear rate is programmed by decades (e.g., 0.1, 1, 10, 100, 300) so that the data distribution is relatively uniform on a logarithmic scale. The beginning and ending shear rates for each decade are programmed along with time intervals such that the acceleration of the rotating plate is roughly uniform. Rheology measurements covered a shear rate interval of from about 0.1 to 300 reciprocal seconds in about 5 minutes. The acquired data is plotted in order to evaluate viscosity at different shear rates by directing the software to plot viscosity versus shear rate on logarithmic scales. In particular, Newtonian fluids for use in this spray delivery system 10 are relatively viscous. Relatively viscous fluids, preferably, have a viscosity greater than about 60 centipoise; more preferably, a viscosity of from about 80 centipoise to about 300 centipoise; and most preferably, a viscosity of from about 80 centipoise to about 170 centipoise.

In the case of a non-Newtonian fluid (where viscosity varies with shear rate), the term high shear rate refers to shear rates found in the exit regions of the spray nozzle, and are from about 100,000 to 200,000 reciprocal seconds. The rheology of a non-Newtonian fluid is characterized using, for example, an Instron Capillary Rheometer System model 3211 along with the manufacturer's prescribed test procedure. The procedure for measuring a high shear rate viscosity using this system includes the use of about a 0.010 inch inner diameter by about 1.5 inch length die, a load cell with about a 50 lbf range, a plunger feed rate of from about 3 to 10 inches per minute, at room temperature conditions. Movement of the plunger through the barrel of the instrument causes flow of the material though the die at a fixed shear rate. The pressure drop through the die is inferred by measurement of the force required to drive the plunger. The output data is in the form of force data, which is post processed to yield viscosity versus shear rate curves using formulas supplied by the manufacturer. In particular, non-Newtonian fluids for use in this spray a high delivery system 10 have a high shear rate have a high shear rate viscosity and are relatively viscous fluids. These relatively viscous products, preferably, have a viscosity greater than about 60 centipoise; more preferably, a viscosity of from about 80 centipoise to about 300 centipoise; and most preferably, a viscosity of from about 80 centipoise to about 170 centipoise.

When dispensing these relatively viscous fluids the pump device 20 should have fluid paths or passages that are relatively large in order to avoid pressure drops where such pressure drops are undesirable. Fluid paths such as the inlet passage 23, the pump chamber 28, and the discharge passage 27 are all preferably cylindrical in shape and have inner diameters that are preferably equal to or greater than about 0.125 inches. Constriction of these fluid paths may result in a slow recharge rate of the pump device 20 following actuation.

As the operating principles of pump devices 20 themselves are generally well-known, a brief overview of their operation with respect to the spray delivery systems 10 according to the present invention is provided. To actuate the spray delivery system 10 and start a dispensing cycle, the trigger 24 is actuated manually, by finger pressure, increasing the fluid pressure within the pump chamber 28 causing the fluid to become a pressurized fluid. The pressurized fluid enters the discharge passage 27. The pressurized fluid travels through the discharge passage 27 to the fan slot spray nozzle 40 (which is depicted in greater detail in the succeeding Figures), and on through the elongated orifice 42 where it is dispensed in the form of a flat fan shaped spray pattern. Once the pump device 20 reaches the end of its travel (or the trigger 24 is released during an incomplete dispensing cycle), pressure within the pump chamber 28 diminishes and fluid flow out of the elongated orifice 42 ceases. If the trigger 24 is then released, a spring force from the spring 15 returns the trigger 24 to its initial position (thereby drawing fluid up through the inlet passage 23 and into the pump device 20), where it is ready for the next dispensing cycle.

Manually operated pump devices 20 used in the present invention have a transient hydraulic pressure dispensing cycle. This transient hydraulic pressure is generated during actuation since the pressure tends to gradually build up during the initial movement of the trigger 24 by the operator's fingers upon applying the force to dispense. This pressure reaches a maximum during initiation of the dispensing cycle, somewhere during the travel of the trigger 24 toward the end of the actuation stroke and thereafter rapidly decreases once the end of the actuation stroke is reached. The maximum hydraulic pressure obtains a magnitude of from about 30 to about 80 psi.; more preferably, the maximum hydraulic pressure is from about 35 to about 45 psi.; most preferably, the maximum hydraulic pressure is about 40 psi. When the preferred force to dispense is applied at an actuation rate of from about 3 inches per second to about 4 inches per second, the time required to achieve this maximum hydraulic pressure is from about 0.4 to about 1.0 seconds; more preferably, this maximum hydraulic pressure is reached at from about 0.5 to about 0.8 seconds. The liquid sheet that is being expelled from the spray nozzle 40 during this transient pressure dispensing cycle is expanding and contracting in width, respectively with these pressure variations. Generally, fan spray patterns dispensed under steady state pressure conditions from fan slot type nozzles have thickened sheet edges that form at the outer edges of the fan spray pattern. This expanding and contracting fan spray pattern, created by the transient pressure nature of this spray delivery system 10, ensures that the thickened sheet edges do not impinge on the surface to be coated at the same locations throughout the dispensing cycle. Thus, the occurrence of areas of high product concentration on the surface to be coated is reduced or eliminated. This helps to reduce the total quantity of fluid required to properly coat a surface with a uniform and evenly distributed layer of fluid product.

Since the spray delivery systems 10 of the present invention may be utilized with a wide variety of fluids it is preferable that the spray delivery system 10 be refillable. Thus, a cap 25 (as seen in FIG. I) is preferably provided for removeably connecting the pump device to the container 30. To enable the pump device 20 to be removed from the container 30, mutually compatible threads (not shown) can be provided on both the cap 25 and the container 30. When the pump device 20 is removed from the container 30, the container 30 may be refilled with fluid product. Additionally, for ease of use and less messy operation during refilling of the container 30, the container 30 may have an enlarged opening which will allow a fluid product to be easily poured into the container 30 from a storage carton. This also enables the container 30 to be refilled in a shorter period of time since more fluid can pass through the enlarged opening. When the container 30 utilizes an enlarged opening the cap 25 will be in the form of a transition piece (not shown) adapted to fit both the enlarged opening of the container 30 and also the pump device 20.

Figure 3:
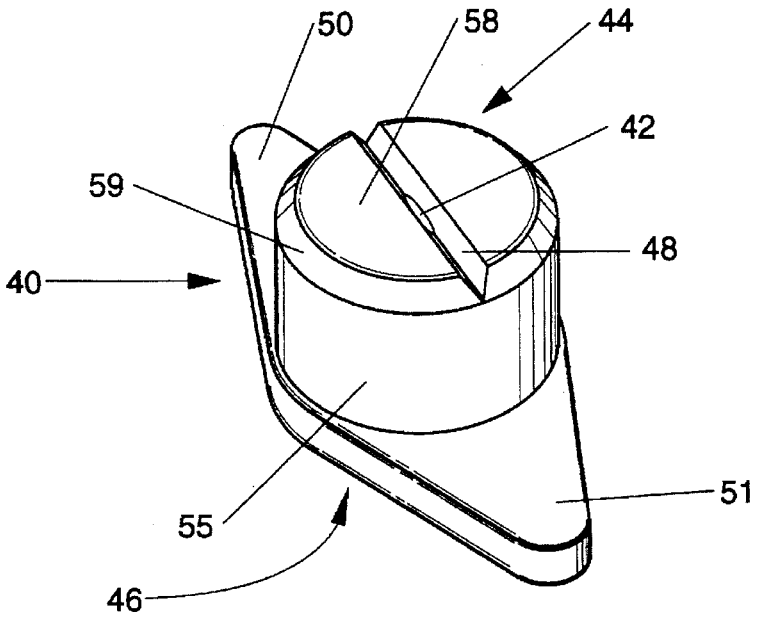
FIG. 3 is an enlarged perspective view of the spray nozzle of FIG. 1.

FIG. 3 shows an enlarged perspective view of the fan slot spray nozzle 40 for use with this spray delivery system 10. The spray nozzle 40 includes a housing 55, which is preferably cylindrical in shape, having an inlet side 46 and an exit side 44. The housing 55 has a nozzle face 58 with a chamfer 59 located on the perimeter of the nozzle face 58 at the exit side 44.

Figure 4:
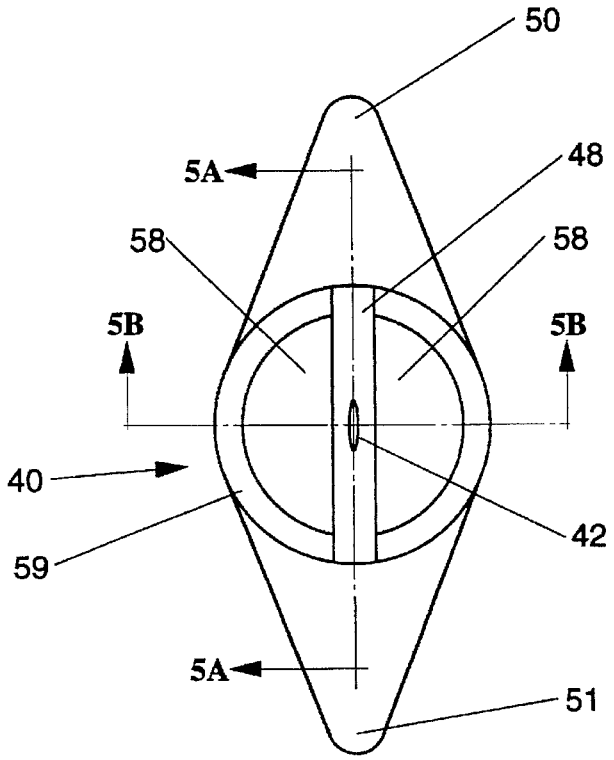
FIG. 4 is an enlarged plan view of the spray nozzle of FIG. 3.

In reference to FIG. 4, the fan slot spray nozzle 40 is seen with the elongated orifice 42 in a centrally located position and being elliptical in shape. The major diameter of the elongated orifice 42, as seen in FIG. 4, is the greater of the widths of the elongated orifice 42. The minor diameter of the elongated orifice 42 is the longest line perpendicular to and bisecting the major diameter. The elongated orifice 42 preferably, has a major diameter of from about 0.03 inches to about 0.05 inches; and most preferably, the major diameter is from about 0.035 inches to about 0.041 inches. The elongated orifice 42 preferably, has a minor diameter of from about 0.008 inches to about 0.017 inches; and most preferably, the minor diameter is from about 0.010 inches to about 0.012 inches. The ratio of the major diameter to the minor diameter is known as the aspect ratio. The aspect ratio of the elongated orifice 42 preferably, is from about 3 to about 4; and more preferably, is from about 3.4 to about 3.8.

Due to the asymmetry or elongated shape of the fan spray pattern produced when fluid is dispensed from this spray delivery system 10, it is convenient to aid the operator by indicating the alignment of the fan spray pattern. This may be accomplished by optionally adding one or more visual or visual/functional features, such as the visual alignment tabs 50, 51 seen in FIG. 4 on the fan spray nozzle 40. As seen in FIGS. 1, 3 and 4, the visual alignment tabs 50, 51 are preferably oriented such that they are aligned with the major axis of the elongated orifice 42. When the visual alignment tabs 50, 51 are in a vertical orientation, likewise the major axis of the elongated orifice 42 will be in a vertical orientation and thus, the fluid will be dispensed from the spray nozzle 40 such that the fan spray pattern is delivered in a predictable orientation. Similarly, when the spray nozzle 40 is rotated the operator will still be able to predict the orientation of the emerging fan spray pattern. Therefore the operator is able to easily and effectively apply a thin, uniform coating of fluid onto the surface to be coated.

Figure 5A:
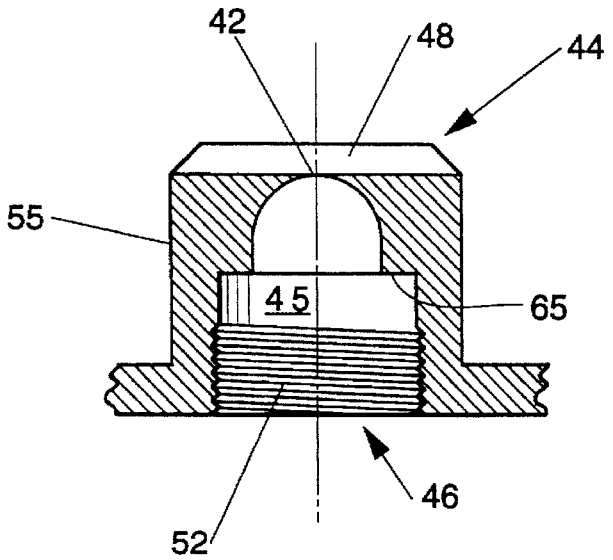
FIG. 5A is a cross-section of the spray nozzle taken along line 5A—5A of FIG. 4.
Figure 5B:
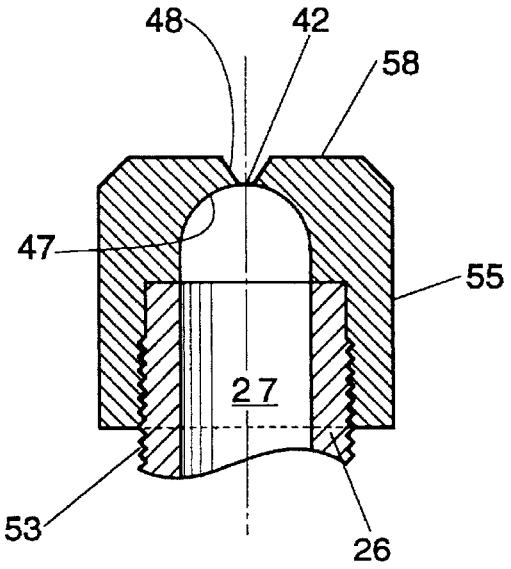
Figure 8A:
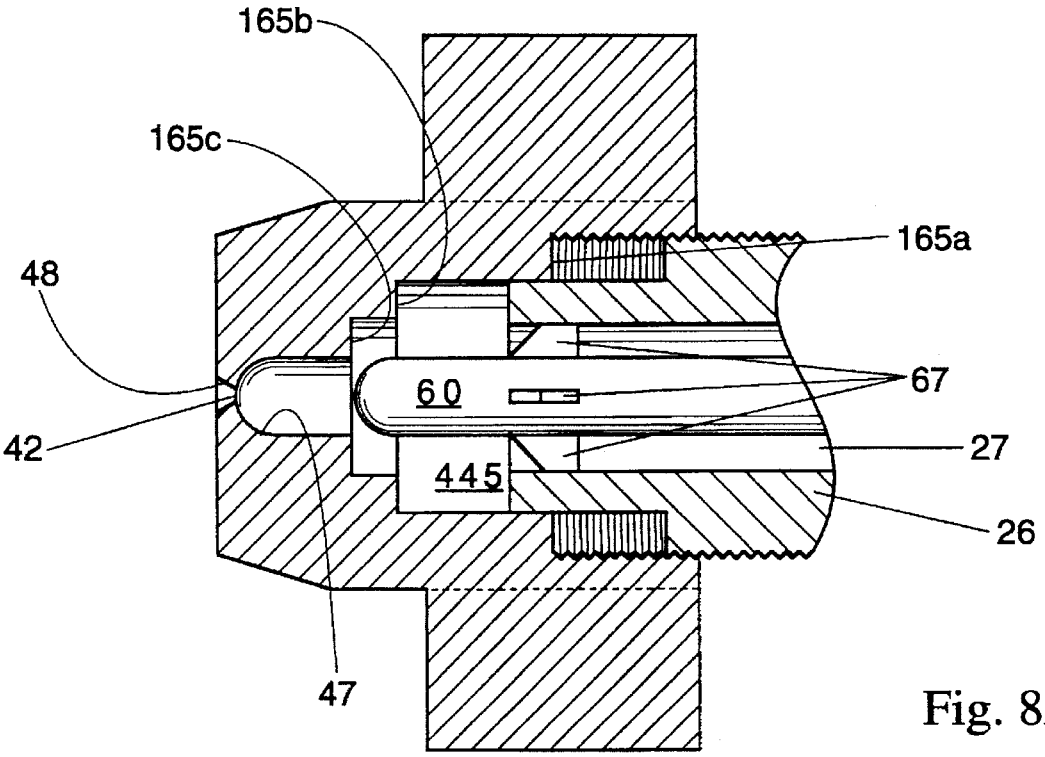
FIG. 8A is a cross-section similar to FIG. 5B of a fourth alternative spray nozzle having a post, shown in the retracted position.
Figure 8B:
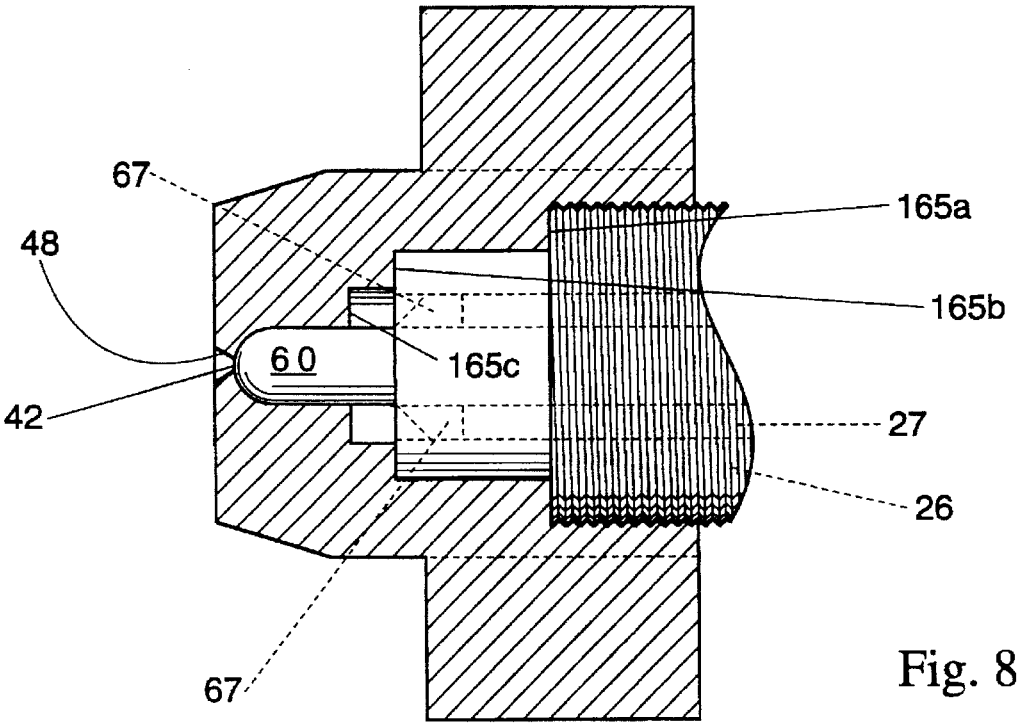
FIG. 8B is a view of the fourth alternative spray nozzle of FIG. 8A, shown in the closed position.

In reference to FIGS. 5A and 5B, a cross-section of the spray nozzle 40 is seen. The housing 55 has an internal recess 45 extending through the inlet side 46 that terminates in an elongated orifice 42 at the exit side 44. The internal recess 45 has a dome shaped interior surface 47 therein and the exit side 44 also has a groove 48 therein which intersects with the internal recess 45 and the interior surface 47 to form the elongated orifice 42. This groove 48 is cut or formed into the nozzle face 58 of the housing 55. The spray nozzle 40 having the internal recess 45 being attached in fluid communication to a distal end of the discharge passage 27 such that the fluid passing through the discharge passage 27 flows through the spray nozzle 40 and converges toward the elongated orifice 42 and is dispensed therefrom in a fan spray pattern. The spray nozzle 40 includes the internal recess 45 preferably, having a shoulder 65 located between the exit side 44 and the inlet side 46. The discharge tube 26 abuts the shoulder 65 when the spray nozzle 40 is properly connected to the pump device 20 such that the elongated orifice 42 is in fluid communication with the pump device 20. The internal recess 45 is used for conducting the fluid from the discharge passage 27 to the elongated orifice 42. Preferably, the portion of the internal recess 45 extending from the inlet side 46 is cylindrical in shape and has an inner diameter that is spaced inwardly at the shoulder 65 and thereafter the internal recess 45 transitions to the dome shaped interior surface 47 at the exit side 44. The portion of the internal recess 45 that extends between the shoulder 65 and the dome shaped interior surface 47 has an inner diameter that is preferably, from about 0.02 inches to about 0.10 inches; more preferably, from about 0.03 inches to about 0.06 inches; and most preferably, about 0.04 inches in length. Optionally, (as seen in FIG. 8A and 8B) multiple shoulders 165*a*, 165*b*, and 165*c* can be utilized to reduce the inner diameter of the internal recess 445 in a step wise fashion.

In the configuration seen in FIGS. 5A and 5B, internal threads 52 are included in the internal recess 45 at the inlet side 46 of the spray nozzle 40. These internal threads 52 engage with external threads 53 located on the distal end of the discharge tube 26 in order for the spray nozzle 40 to be threadably connected to the discharge tube 26. Various thread sizes as well as various other mechanical methods of connecting the spray nozzle 40 to the discharge tube 26 may be used. For example, an alternative method of connecting the discharge tube 26 to the spray nozzle 40 may be a snap fit type connection.

The interior surface 47 is dome shaped, that is, resembling or shaped like a substantially hemispherical vault or in the form of a portion of a substantially spherical shape. The interior surface 47 most preferably has a hemispherical diameter that is substantially equal to the inner diameter of the internal recess 45. The exit side 44 has a groove 48 cut therethrough which intersects the interior surface 47 forming the elongated orifice 42. During a dispensing cycle of this spray delivery system 10 it is the transition of the internal recess 45 to the dome shaped interior surface 47 that causes the convergence of the fluid streamlines toward the elongated orifice 42 at high stream velocities when the fluid is forced through the spray nozzle 40. The shape of the elongated orifice 42 forces the fluid streamlines to form a flat liquid sheet oriented parallel to the major diameter of the elongated orifice 42 upon exiting or being dispensed from the confines of the spray nozzle 40. External to the spray nozzle 40 the liquid sheet forms ligaments and thereafter droplets which disperse or disintegrate into a fan shaped atomized spray pattern. Generally, this fan spray pattern consists of dispersed droplets of fluid arranged such that a transverse cross-section of the fan spray pattern would be elongated, elliptical, or oblong in shape. The dispersed droplets of fluid may be finely dispersed, such as an atomized spray, or even more coarsely dispersed representing larger droplets of fluid. When this fan spray pattern contacts the surface intended to be coated with the fluid, a thin and uniform coating of fluid is produced having an elongated shape.

Figure 6:
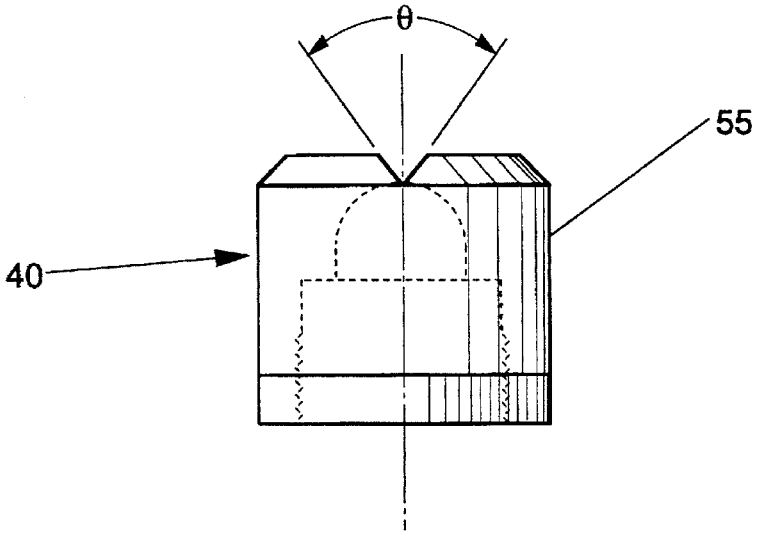
FIG. 6 is an enlarged elevational view of the spray nozzle of FIG. 3 showing the V-shaped groove.

FIG. 6 depicts a "V-shaped" groove 48 on the spray nozzle 40. This "V-shaped groove 48 has an angle θ (Theta), which represents the average included angle of the groove 48 measured along the major diameter of the elongated orifice 42. As defined herein, the angle θ will of necessity be some value between about 0° and 180°, with the 0° representing a groove 48 with parallel sides and 180° representing no groove 48 at the exit side 44. The angle θ for use in the spray nozzle 40 of the present invention preferably, is from about 20° to about 90°; more preferably, from about 30° to about 50°; and most preferably has a range of from about 41° to about 44°. It has been found that a triangular prismatic or "V-shaped" groove 48 and a hemispherical interior surface 47 in fluid communication with a cylindrical liquid inlet such as the internal recess 45 work well to produce the liquid sheet which disintegrates into an atomized fan spray pattern.

While a wide variety of fan slot spray nozzles 40 may be suitable for use in the spray delivery system 10 of the present invention, the spray nozzle 40 resembles a type of nozzle typically used in industrial applications. Spray nozzles 40 of this general type have a similar orifice configuration as commercially available versions sold by Lechler, Inc. under the model No. 652.276 having the trade name "mini fan". A first alternative embodiment of spray nozzle 40 may be fabricated as an assembly by machining threads onto the model No. 652.276 "mini fan" nozzle and then connecting a bushing or sleeve to the nozzle such that it is attached in fluid communication to the discharge passage 27 of the pump device 20. While the spray nozzle 40 may be constructed as an assembly, the preferred embodiment is a unitary construction or fabrication resulting in a one piece spray nozzle 40.

Figure 7A:
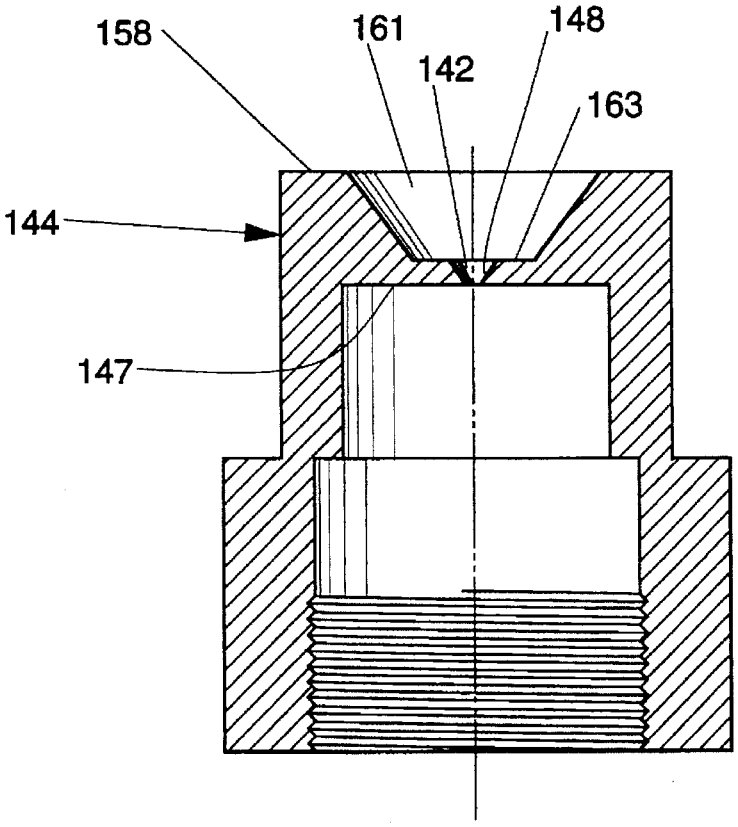
FIG. 7A is an enlarged cross-section similar to FIG. 5B of a first alternative spray nozzle suitable for use with the present invention.

In a second alternative configuration of the spray nozzle 40 seen in FIG. 7A, the spray nozzle 40 includes a cavity 161 located at the exit side 144. The cavity 161 extends from the nozzle face 158 to the cavity bottom 163 which is spaced axially from interior surface 147. The groove 148 cut through or formed in the cavity bottom 163 intersects with the interior surface 147 forming the elongated orifice 142. This groove 148 may be, for example, in the form of a slot or even a substantially elongated frusta-conical shape. The cavity 161 is cup shaped and provides a recessed area around the elongated orifice 142. This cavity 161 may be of various geometric shapes, for example, concave, frusta-conical, cylindrical, rectangular, and the like. The cavity 161 functions as a basin and helps to prevent excess dripping of fluid from the spray nozzle 140 after completion of a dispensing cycle. FIG. 7A additionally depicts an alternative configuration for the interior surface 147 which is shown in a substantially flat configuration and may be, for example, constructed of a flexible membrane or a substantially resilient material. While the preferred configuration of the interior surface 147 is substantially dome shaped, other configurations of the interior surface 147 may also be utilized which provide for fluid convergence toward the elongated orifice 142. For example, the interior surface 147 may also be substantially conical, concave, curved, frusta-conical, tapered, and the like, or any combination of these configurations.

Figure 7B:
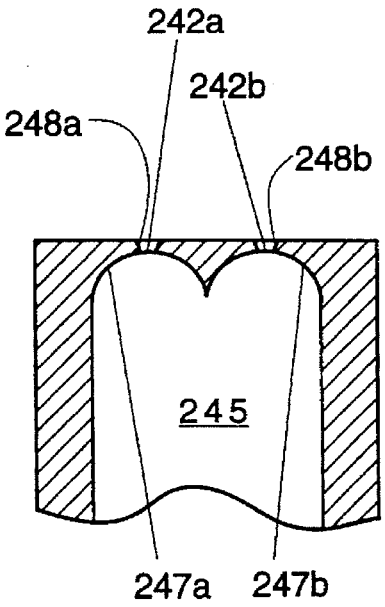
FIG. 7B is an enlarged cross-section similar to FIG. 5B of a second alternative spray nozzle having two elongated orifices suitable for use with the present invention.
Figure 7C:
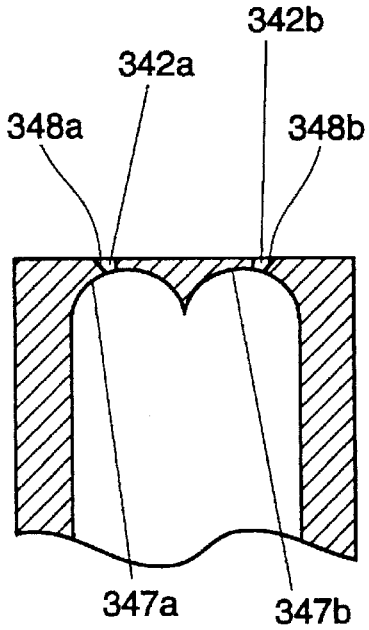
FIG. 7C is an enlarged cross-section similar to FIG. 5B of a third alternative spray nozzle having two oriented elongated orifices suitable for use with the present invention.

The third alternative embodiment of spray nozzle 40 seen in FIG. 7B has an internal recess 245 with dual dome shaped interior surfaces 247*a* and 247*b*. Two grooves 248*a* and 248*b* are also provided which, arranged together with the interior surfaces 247*a* and 247*b*, form two elongated orifices 242*a* and 242*b*. These dual elongated orifices 242*a* and 242*b* allow dispensing of the fluid in a twin fan spray pattern. The grooves 248*a* and 248*b* are centered in the dome shaped interior surfaces 247*a* and 247*b* of the embodiment seen in FIG. 7B. In FIG. 7C the grooves 348*a* and 348*b* are offset from the central location on the dome shaped interior surfaces 347*a* and 347*b*. The alignment or placement of the grooves 348*a* and 348*b* along with variations in the angle θ can allow the fan spray pattern to be tailored so that a wider area of coverage can be obtained. Additionally, the fan spray patterns exiting from the individual elongated orifices 342*a* and 342*b* may overlap or be directed to different locations on a surface to be coated, providing for an improved distribution of the fan spray pattern on the surface. Although only two elongated orifices 342*a* and 342*b* are seen in FIG. 7C, additional elongated orifices 342*a* and 342*b* may be provided.

The spray delivery system 10 of the present invention may be used to disperse virtually any fluid product in a more controlled and more consistent fashion. However, it has been found to be particularly advantageous to use the spray delivery system 10 for dispersing viscous and solid laden liquids. Examples of such liquids include, but are not limited to: cooking oils, pan coatings, flavor oils, mouthwashes, dyes, hair sprays, lubricating oils, liquid soaps, cleaning solutions, laundry detergents, dishwashing detergents, pretreaters, hard surface cleaners, paints, polishes, window cleaners, cosmetics, rust preventatives, surface coatings, and the like.

The solids laden liquids suitable for use in the present invention may contain a substantial amount of solid materials suspended in them, preferably, up to about 3% by weight of solid particulate; more preferably, up to about 6% by weight of solid particulate; and most preferably, up to about 10% by weight of solid particulate material having a particle size up to 425 microns. Preferably the solids contained in the solids laden liquids have a particle size of less than about 150 microns and even more preferably the solids have a particle size less than the minor diameter of the elongated orifice 42. The level of solids and the size of the solid particles contained in the solids laden liquid may vary, however, it is important to control the amount and size of the solid particles contained in the fluid to avoid or reduce the likelihood of clogging the spray nozzle 40.

Preferred liquids for use in the spray delivery system 10 are vegetable oil based cooking sprays. These products are often formulated with a large percentage (from about 80 to 100% by weight) of vegetable oil and are relatively viscous and may also be solids laden. Typically, these products include minor percentages of lecithin, emulsifiers and flavor enhancers along with other ingredients and solids, for example, flavor solids, salts, or other solid particulate material used to enhance the fluid product's performance, see for example, U.S. Pat. No. 4,385,076, issued May 24, 1983 to Crosby, and U.S. Pat. No. 4,384,008, issued May 17, 1983 to Millisor.

A particularly preferred cooking oil which has performed well with the spray delivery system 10 of the present invention comprises vegetable oil, lecithin, solid flavor particles, carotene and other liquid flavors; wherein from about 95% to about 100% of the particles have a particle size less than 425 microns (U.S. 40 mesh); from about 15% to about 20% of the particles have a particle size greater than 75 microns (U.S. 200 mesh); from about 30% to about 50% of the particles have a particle size greater than 53 microns (U.S. 270 mesh); and from about 35% to about 60% of the particles have a particle size less than 38 microns (U.S. 400 mesh). As used herein the term particle size refers to the over-all width or diameter of the particle.

The spray nozzle 40 has a manual cleaning and/or closure feature seen in FIGS. 8A and 8B. In this embodiment, a post 60 is affixed to the distal end of the discharge passage 27 so as to allow the fluid to flow through the discharge passage 27 in an open or retracted position (seen in FIG. 8A). The post 60 is connected to the discharge tube 26 by radially outwardly extending struts 67. This post 60 is used to help shut off the elongated orifice 42 when the spray nozzle 40 is in the non-operating or closed position (seen in FIG. 8B). The spray nozzle 40 post 60 is moveable between an open position and a closed position in order to shut off the elongated orifice 42. This may help to protect the fluid from exposure to ambient atmosphere and also to clear or clean away any obstructions in the spray nozzle 40 by ejecting or pushing the obstruction (e.g. particles, solids, agglomerates) out from the internal recess 445 and through the elongated orifice 42. Preferably the manually retractable post 60 has a contour and size that is substantially the same as the interior surface 47.

In this embodiment, the spray nozzle 40 post 60 may be retracted or the elongated orifice 42 opened and closed by rotating the spray nozzle 40 on the external threads 53 of the discharge tube 26. The threaded engagement between the internal threads 52 on the spray nozzle 40 and the external threads 53 on the discharge tube 26 allows for translating movement between the post 60 and the elongated orifice 42. Rotation of the spray nozzle 40 on the threads will translate the elongated orifice 42 post 60 toward or away from the post 60. Optionally, this translational movement may be accomplished using many other mechanical methods such as, for example, sliding engagement or the like. Most preferably, the spray nozzle 40 post 60 can be sufficiently retracted from the post 60 to allow an opening substantially equal to or greater in area than that of the discharge passage 27 between the post 60 and the internal recess 445 so that the post 60 does not obstruct the fluid flow through the spray nozzle 40.

Figure 9:
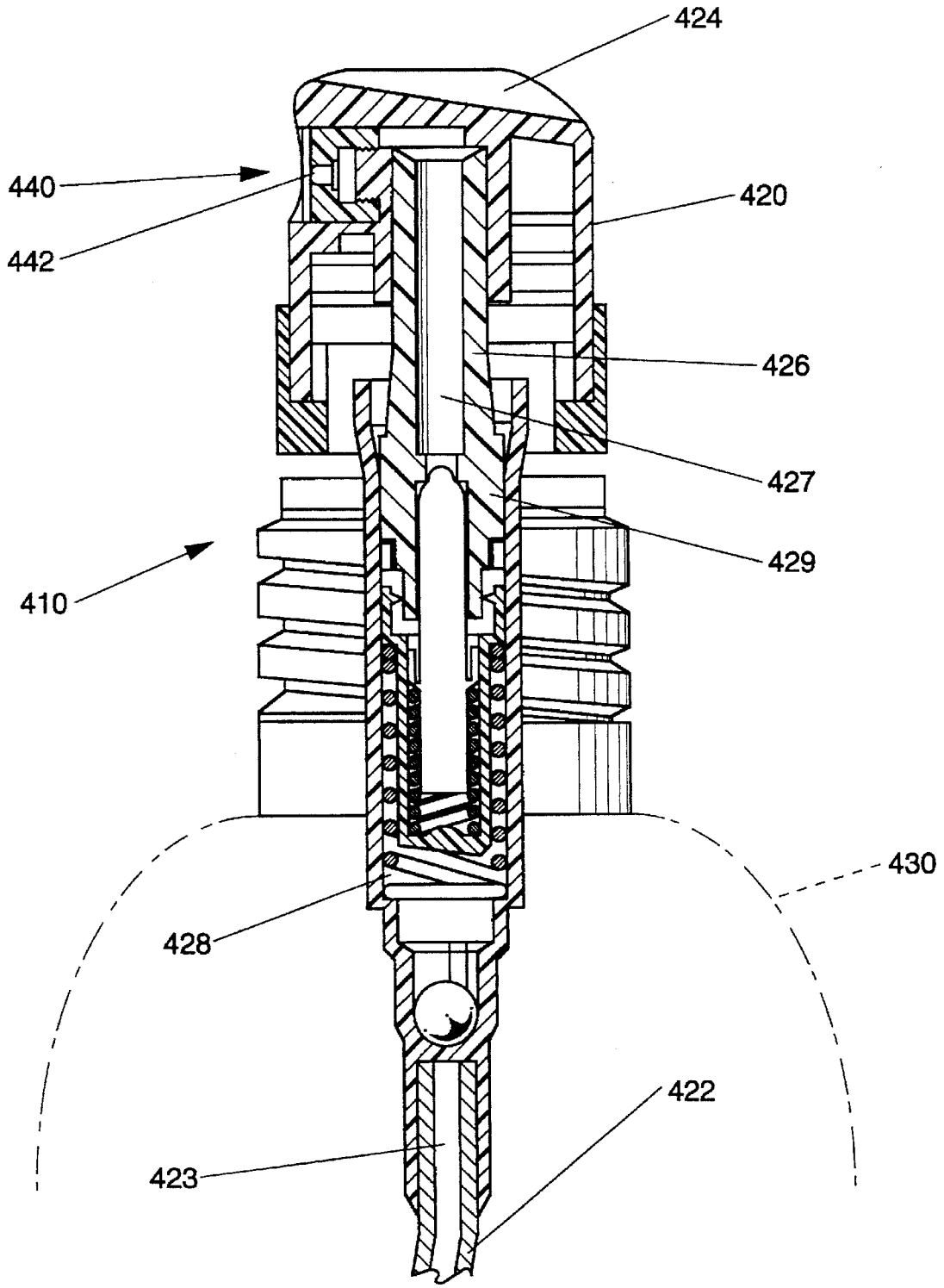
FIG. 9 is a partial cross-section similar to FIG. 2 of an alternative spray delivery system configuration according to the present invention.

While the presently preferred version of the spray delivery system 10 employs a trigger operated sprayer type pump device 20 as depicted in FIG. 1, a reciprocating finger pump type pump device 420 could also be employed in the spray delivery system 410 as depicted in FIG. 9. In such a configuration, the finger button 424 replaces the trigger 24, seen in FIG. 1, as the actuator. Other elements depicted include a spray nozzle 440 incorporated into the finger pump 420, a container 430 (shown in outline only) to house the fluid, a pump chamber 428, and a inlet tube 422 having an inlet passage 423 therein that extends downward within the container 430 from the pump chamber 428. In this reciprocating finger pump type pump device 420 the spray nozzle 440 is connected to the finger button 424 so as to be in fluid communication with the discharge passage 427 of the discharge tube 426 and the finger button 424 reciprocally engages a piston 429 that is slidably fitted within the pump chamber 428 in order to effectuate actuation of the spray delivery system 410. For typical operation of a reciprocating finger pump, see for example, U.S. Pat. No. 4,986,453 issued Jan. 22, 1991 to Lina et al.

While the spray delivery system 10 and fan slot spray nozzle 40 according to the present invention may be fabricated or manufactured in any suitable fashion, a presently preferred method of forming the spray nozzle 40 is by injection molding. A preferred material for the spray nozzle 40 is polypropylene. Alternatively, this spray nozzle 40 may be molded or machined from any number of well known materials, for example, polypropylene (PP), polystyrene (PS), polytetrafluoroethylene (PTFE), polyvinyl chloride (PVC), polyvinylidenefloride (PVDF), aluminum, brass, steel, along with other plastics, or other metals, or the like. Similarly, the container 30 may be blow molded using any number of well known materials, for example, high-density polyethylene (HDPE), polyethylene terepthalate (PET), or the like.

Although particular versions and embodiments of the present invention have been shown and described, various modifications may be made to the spray delivery system 10 and the method of assembly or operation thereof without departing from the teachings of the present invention. The terms used in describing the invention are used in their descriptive sense and not as terms of limitation, it being intended that all equivalents thereof be included within the scope of the appended claims.

What is claimed is:

1. A hand holdable spray delivery system for dispensing a fluid, said spray delivery system comprising:

(a) a container housing said fluid;

(b) said fluid having a viscosity greater than about 60 centipoise;

(c) a manually actuated pump device mounted on said container, said pump device including an inlet passage, a pump chamber, and a discharge passage having a distal end, all being connected in fluid communication so that said fluid is pumped from within said container, through said inlet passage, into said pump chamber and through said discharge passage upon manual actuation of said pump device;

(d) a spray nozzle including a housing having an inlet side and an exit side, said housing having an internal recess through said inlet side that terminates at said exit side, said internal recess having a dual dome shaped interior surface therein, said exit side having two V-shaped grooves therein which arranged together with said dual dome shaped interior surface forms two elongated orifices, said internal recess being attached in fluid communication to said distal end of said discharge passage such that said fluid passing through said discharge passage flows through said spray nozzle and converges toward said elongated orifices and is dispensed therefrom in a fan spray pattern.

2. The hand holdable spray delivery system of claim 1 wherein said V-shaped grooves are offset from a central location on said dual dome shaped interior surface.

3. The hand holdable spray delivery system of claim 1 wherein said spray nozzle further comprises a post affixed to said distal end of said discharge passage so as to allow said fluid to flow through said discharge passage in an open position, said spray nozzle being moveable between said open position and a closed position.

4. The hand holdable spray delivery system of claim 3 wherein said post has a contour and size that is substantially the same as said interior surface.

5. The hand holdable spray delivery system of claim 1 wherein said pump device further comprises a trigger operated sprayer including a trigger which serves as an actuator, said trigger reciprocally engages a piston that is slidably fitted within said pump chamber in order to effectuate actuation of said spray delivery system.

6. The hand holdable spray delivery system of claim 1 wherein said pump device further comprises a reciprocating finger pump having said spray nozzle connected to a finger button so as to be in fluid communication with the discharge passage, said finger button reciprocally engages a piston that is slidably fitted within said pump chamber in order to effectuate actuation of said spray delivery system.

7. The hand holdable spray delivery system of claim 1 wherein said fluid comprises a vegetable oil based cooking spray.

* * * * *